US007118416B2

(12) United States Patent
Montena et al.

(10) Patent No.: US 7,118,416 B2
(45) Date of Patent: Oct. 10, 2006

(54) CABLE CONNECTOR WITH ELASTOMERIC BAND

(75) Inventors: Noah Montena, Syracuse, NY (US); Michael T. Fox, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/781,376

(22) Filed: Feb. 18, 2004

(65) Prior Publication Data

US 2005/0181652 A1 Aug. 18, 2005

(51) Int. Cl.
*H01R 9/05* (2006.01)

(52) U.S. Cl. ..... 439/584

(58) Field of Classification Search ..... 439/578, 439/584, 583, 274, 275, 287, 582
See application file for complete search history.

(56) References Cited

U.S. PATENT DOCUMENTS

| | | | | |
|---|---|---|---|---|
| 2,258,737 | A | | 10/1941 | Browne |
| 2,651,529 | A | | 9/1953 | Wayman |
| 3,184,706 | A | | 5/1965 | Atkins |
| 3,219,367 | A | | 11/1965 | Franck |
| 3,307,138 | A | | 2/1967 | Swartz |
| 3,406,373 | A | | 10/1968 | Forney, Jr. |
| 3,498,647 | A | | 3/1970 | Schroder |
| 3,621,413 | A | | 11/1971 | Hilbert |
| 3,629,792 | A | | 12/1971 | Dorrell |
| 3,671,922 | A | | 6/1972 | Zerlin et al. |
| 3,678,446 | A | * | 7/1972 | Siebelist ..... 439/583 |
| 3,846,738 | A | | 11/1974 | Neporim |
| 3,915,539 | A | | 10/1975 | Collins |
| 3,985,418 | A | | 10/1976 | Spinner |
| 4,046,451 | A | | 9/1977 | Juds et al. |
| 4,126,372 | A | | 11/1978 | Hashimoto et al. |
| 4,150,250 | A | | 4/1979 | Lundeberg |
| 4,156,554 | A | | 5/1979 | Aujla |
| 4,280,749 | A | | 7/1981 | Hemmer |
| 4,346,958 | A | | 8/1982 | Blanchard |
| 4,373,767 | A | | 2/1983 | Cairns |
| 4,408,821 | A | | 10/1983 | Forney, Jr. |
| 4,444,453 | A | * | 4/1984 | Kirby et al. ..... 439/583 |
| 4,525,000 | A | | 6/1985 | Bachle |
| 4,575,274 | A | | 3/1986 | Hayward |
| 4,583,811 | A | | 4/1986 | McMills |
| 4,600,263 | A | | 7/1986 | DeChamp et al. |
| 4,614,390 | A | | 9/1986 | Baker |
| 4,645,281 | A | | 2/1987 | Burger |
| 4,650,228 | A | | 3/1987 | McMills et al. |
| 4,655,159 | A | | 4/1987 | McMills |

(Continued)

FOREIGN PATENT DOCUMENTS

| | | |
|---|---|---|
| DE | 1 191 880 | 4/1954 |

(Continued)

*Primary Examiner*—Phuong Dinh
(74) *Attorney, Agent, or Firm*—Wall Marjama & Bilinski LLP

(57) ABSTRACT

A connector for a coaxial cable includes a connector body and a fastening member for connecting said connector to an object such as an equipment port. A post is fitted at least partially inside the connector body for receiving a prepared end of the cable. A compression member is fitted to a back of the connector body. An elastomeric band is fitted inside a cavity formed at least in part by the compression member. Axial movement of the compression member onto said connector body causes the elastomeric band to seal an outer layer of the cable to the connector to isolate the inside of the connector from environmental influences.

21 Claims, 7 Drawing Sheets

U.S. PATENT DOCUMENTS

| | | | |
|---|---|---|---|
| 4,668,043 | A | 5/1987 | Saba et al. |
| 4,674,818 | A | 6/1987 | McMills et al. |
| 4,676,577 | A | 6/1987 | Szegda |
| 4,679,827 | A | 7/1987 | Law |
| 4,692,562 | A | 9/1987 | Nattel |
| 4,697,861 | A | 10/1987 | Mitchell |
| 4,700,743 | A | 10/1987 | L'Henaff et al. |
| 4,707,047 | A | 11/1987 | Michaels et al. |
| 4,747,789 | A | 5/1988 | Gliha |
| 4,755,152 | A | 7/1988 | Elliot et al. |
| RE32,787 | E | 11/1988 | Gallusser et al. |
| 4,806,116 | A | 2/1989 | Ackerman |
| 4,808,128 | A | 2/1989 | Werth |
| 4,834,675 | A | 5/1989 | Samchisen |
| 4,842,363 | A | 6/1989 | Margolin et al. |
| 4,857,007 | A | 8/1989 | Michaels et al. |
| 4,857,015 | A | 8/1989 | Michaels et al. |
| 4,869,679 | A | 9/1989 | Szegda |
| 4,889,497 | A | 12/1989 | Riches |
| 4,892,275 | A | 1/1990 | Szegda |
| 4,902,246 | A | 2/1990 | Samchisen |
| 4,923,412 | A | 5/1990 | Morris |
| 4,932,900 | A | 6/1990 | Gliha |
| 4,990,105 | A | 2/1991 | Karlovich |
| 4,990,106 | A | 2/1991 | Szegda |
| 5,011,434 | A | 4/1991 | Blunt |
| 5,024,606 | A | 6/1991 | Ming-Hwa |
| 5,059,139 | A | 10/1991 | Spinner |
| 5,066,248 | A | 11/1991 | Gaver |
| 5,073,129 | A | 12/1991 | Szegda |
| 5,087,795 | A | 2/1992 | Guginsky |
| 5,127,853 | A | 7/1992 | McMills et al. |
| 5,194,692 | A | 3/1993 | Gallusser et al. |
| 5,195,906 | A | 3/1993 | Szegda |
| 5,207,602 | A | 5/1993 | McMills et al. |
| 5,283,853 | A | 2/1994 | Szegda |
| 5,295,864 | A | 3/1994 | Birch et al. |
| 5,310,359 | A | 5/1994 | Chadbourne et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,444,810 | A | 8/1995 | Szegda |
| 5,456,614 | A | 10/1995 | Szegda |
| 5,470,257 | A | 11/1995 | Szegda |
| 5,494,454 | A | 2/1996 | Johnsen |
| 5,516,985 | A | 5/1996 | Merkel et al. |
| 5,542,861 | A | 8/1996 | Anhalt et al. |
| 5,586,910 | A | 12/1996 | DelNegro et al. |
| 5,596,176 | A | 1/1997 | Everitt |
| 5,600,094 | A | 2/1997 | McCabe |
| 5,607,325 | A | 3/1997 | Toma |
| 5,711,066 | A | 1/1998 | Castaldo |
| 5,735,704 | A | 4/1998 | Anthony |
| 5,862,289 | A | 1/1999 | Walter et al. |
| 5,863,220 | A | 1/1999 | Holliday |
| 5,866,849 | A | 2/1999 | Tuvy et al. |
| 5,943,460 | A | 8/1999 | Mead et al. |
| 6,032,358 | A | 3/2000 | Wild |
| 6,089,912 | A | 7/2000 | Tallis et al. |
| 6,089,913 | A | 7/2000 | Holliday |
| 6,153,830 | A | 11/2000 | Montena |
| 6,194,654 | B1 | 2/2001 | Buehler et al. |
| 6,226,068 | B1 | 5/2001 | Arcykiewicz et al. |
| 6,386,914 | B1 | 5/2002 | Collins et al. |
| 6,394,464 | B1 | 5/2002 | Moreau |
| 6,425,782 | B1 | 7/2002 | Holland |
| 6,767,248 | B1 * | 7/2004 | Hung ..... 439/578 |
| 6,805,584 | B1 * | 10/2004 | Chen ..... 439/578 |

FOREIGN PATENT DOCUMENTS

| | | |
|---|---|---|
| EP | 0 265 276 | 4/1988 |
| GB | 1087 228 | 10/1967 |
| GB | 1270 846 | 4/1972 |
| GB | 2019 665 | 10/1979 |
| GB | 2079 549 A | 1/1982 |

* cited by examiner

CABLE CONNECTOR WITH ELASTOMERIC BAND

FIELD OF THE INVENTION

This invention relates generally to the field of cable connectors for CATV systems, and more particularly to a cable connector with an elastomeric band which seals the cable connector to a cable.

BACKGROUND OF THE INVENTION

A problem with cable connections exposed to the weather is that the connections are susceptible to moisture entering the connection whenever the cable connector is improperly or inadequately connected to the cable. Many attempts have been made to ensure that cable connections are sealed against moisture etc. from the environment. Many of the attempts require using a connector body made of two or more components in order to contain an adequate seal, thus increasing the complexity of the cable connector.

SUMMARY OF THE INVENTION

Briefly stated, a connector for a coaxial cable includes a connector body and a fastening member for connecting said connector to an object such as an equipment port. A post is fitted at least partially inside the connector body for receiving a prepared end of the cable. A compression member is fitted to a back of the connector body. An elastomeric band is fitted inside a cavity formed at least in part by the compression member. Axial movement of the compression member onto said connector body causes the elastomeric band to seal an outer layer of the cable to the connector to isolate the inside of the connector from environmental influences.

According to an embodiment of the invention, a connector for a coaxial cable includes a connector body; a fastening member for connecting the connector to an object; a post fitted at least partially inside the connector body for receiving a prepared end of the cable; a compression member fitted to the connector body; and an elastomeric band fitted inside a cavity formed at least in part by the compression member; wherein axial movement of the compression member onto the connector body causes the elastomeric band to deform and seal an outer layer of the cable to the connector to isolate an inside of the connector from environmental influences.

According to an embodiment of the invention, a connector for a coaxial cable includes a connector body; first connection means for connecting the connector to an object; and second connection means for connecting a prepared end of the cable to the connector; wherein the second connection means includes an elastomeric band for sealing an outer layer of the cable to the connector to isolate an inside of the connector from environmental influences.

According to an embodiment of the invention, a method of constructing a connector for a coaxial cable includes the steps of providing a connector body; providing a fastening member for fastening the connector body to an object; providing a compression member; fitting an elastomeric band into a cavity formed at least in part by the compression member; inserting a prepared end of the cable through the compression member and the elastomeric band; and fitting the prepared cable end and the compression member to the connector body, wherein axial movement of the compression member onto the connector body causes the elastomeric band to deform and seal an outer layer of the cable to the connector to isolate an inside of the connector from environmental influences.

DETAILED DESCRIPTION OF THE PREFERRED EMBODIMENT

Figure 1:
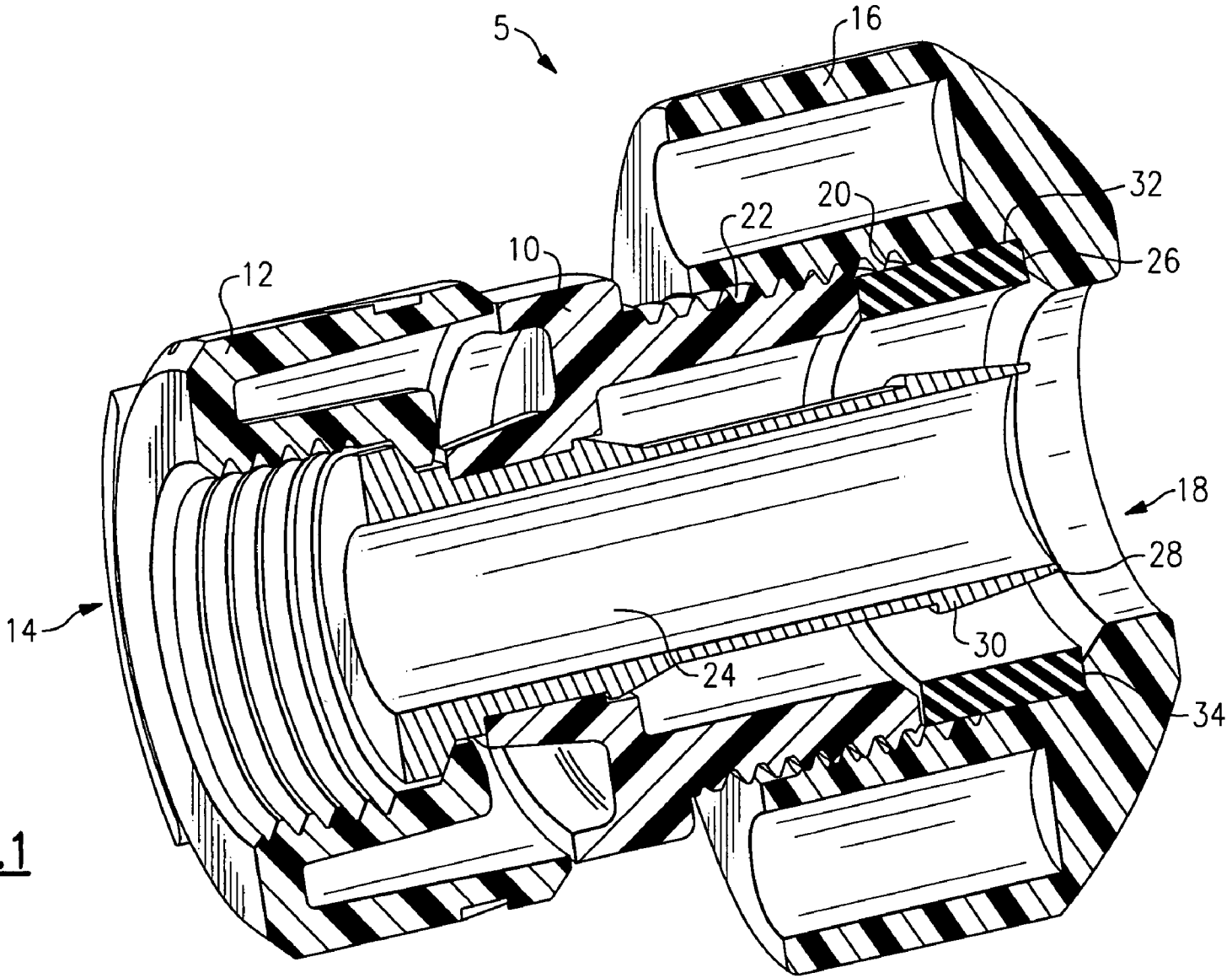
FIG. 1 shows a partial cutaway perspective view of a connector according to an embodiment of the invention.

Referring to FIG. 1, a connector 5 includes a connector body 10 with a nut 12 on a front end 14 of body 10. Nut 12 is shown in this embodiment as a nut for connecting connector 5 to an F-port, but the type of connection is not an essential part of the present invention. A compression nut 16 is connected to body 10 at a back end 18 of body 10 via a plurality of threads 20 on compression nut 16 engaging a plurality of threads 22 on body 10. A post 24 is contained within connector 5. An elastomeric band 26 is disposed within a cavity 32 formed in part by a shoulder 34 of compression nut 16. "Band" is used in the sense of a flat strip, i.e., the width is greater than the thickness. (The "length" would be the circumference of the band, with the width being in the radial direction.) An O-ring is not considered a band and would not work as a replacement for the band of the present invention. Connector 5 is intended to be used with a conventional coaxial cable (not shown) which consists of an inner or center conductor surrounded by a dielectric material which in turn is surrounded by a braided ground return sheath. A cable jacket then surrounds the sheath. As a coaxial cable end (not shown) is inserted into back end 18 of connector 5, an end 28 of post 24 fits between the sheath and the dielectric, so that the dielectric and center conductor fit inside post 24, with the sheath and cable jacket between post 24 and connector body 10. In this embodiment, post 24 is of metal with connector body 10, nut 12, and compression nut 16 being of plastic. The electrical ground path thus goes from the cable sheath to post 24 to a ground portion (not shown) of the terminal that connector 5 is screwed into. Post 24 can also be of plastic when not needed to conduct an electrical path.

Post 24 preferably includes a barbed portion 30, and as compression nut 16 is tightened onto body 10, elastomeric band 26 is forced to deform around the cable jacket, resulting in decreased length and increased thickness. In it's "open" position, i.e., when compression nut 16 is not tightened onto body 10, band 26 has enough clearance to allow the cable to pass through easily. By tightening compression nut 16 onto body 10, which applies a compressive force to elastomeric band 26, band 26 is squeezed inward onto the cable, thus creating a weather seal, as well as providing a great deal of normal force between elastomeric band 26 and the cable sheathing, thus providing retention force to the cable/connector combination. In addition to the tractive forces created by surface friction, the coaction of barbed portion 30 under the cable sheathing along with the inward pressure of elastomeric band 26 cause the cable sheath to conform closely to the profile of barbed portion 30, thus creating a mechanical interlock.

This type of connector easily accommodates a broad range of cable diameters within a given cable family because of the flowable nature of elastomeric band 26 which conforms to the surface irregularities of the cable. Elastomers are also "sticky" which enables elastomeric band 26 to create a better seal than otherwise. Types of connectors with which elastomeric band 26 can be used include tool-compressed, standard compression styles, hand tightened styles, etc. In addition, elastomeric band 26 could be added to an existing connector design as a redundant means of sealing.

Because the sealing and gripping are done by a small, contained element of the connector, the exterior of the connector can be made of whatever material suits a particular application. For instance, for outdoor applications the exterior of the connector can be entirely of brass for increased customer appeal, while a hand-tightened all plastic version with only a metal post 24 could easily be injection molded for the indoor consumer market. Outdoor versions of connector 5 can include a brass nut 12, a brass or stainless steel post 24, a brass or die-cast zinc body 10, and a brass or stainless steel compression nut 16.

Figure 2:
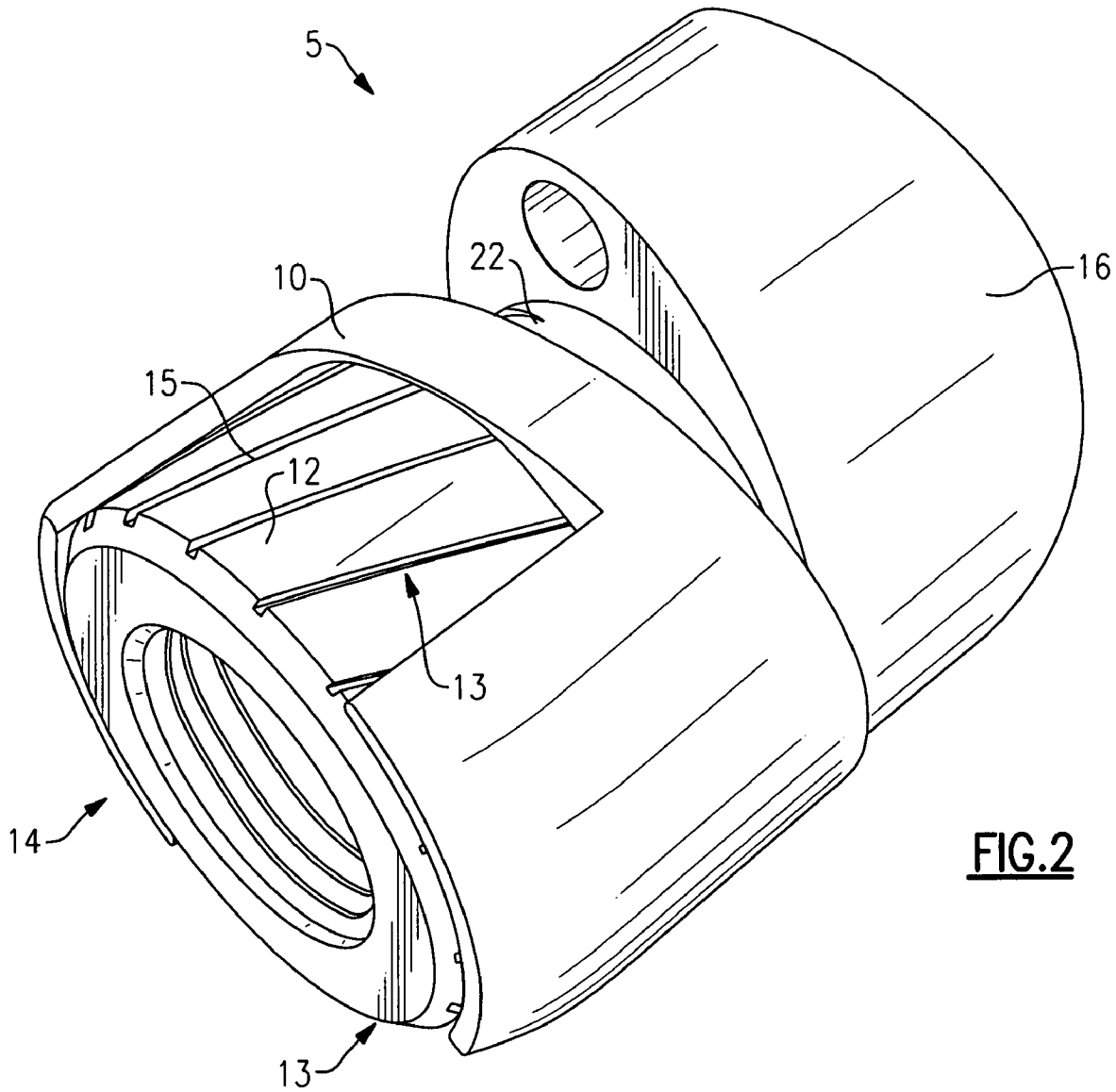
FIG. 2 shows a perspective view of an embodiment of the invention, prior to installation, where the connector components are of plastic.
Figure 3:
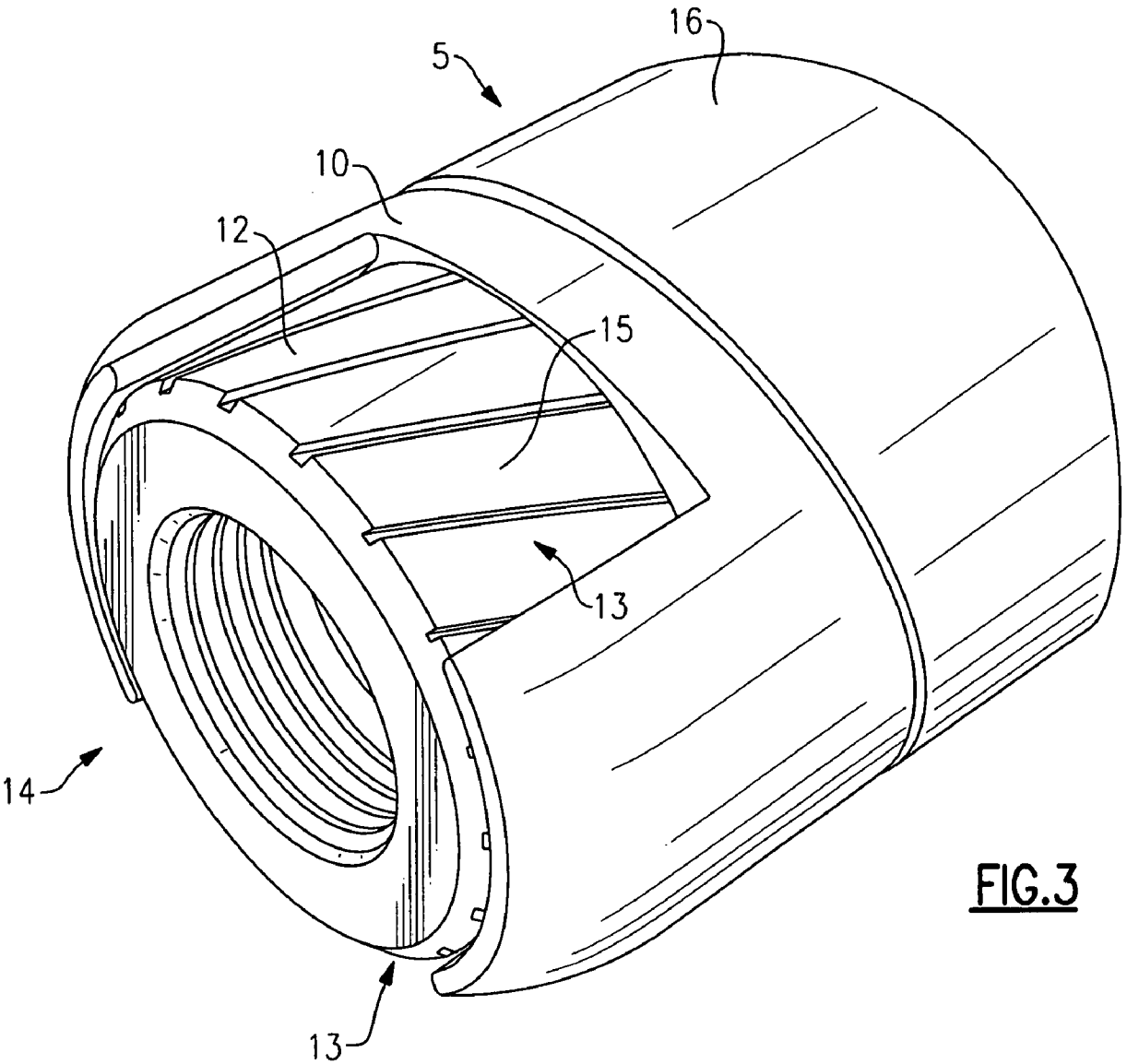
FIG. 3 shows a perspective view of an embodiment of the invention, after installation, where the connector components are of plastic.

FIG. 2 shows a plastic version of the embodiment of FIG. 1 prior to installation, while FIG. 3 shows the embodiment of FIG. 2 after the embodiment has been installed on a cable (not shown). In the plastic version, all parts are preferably plastic except for post 24. A pair of reveals 13 permit easy thumb and finger access to a knurled portion 15 of plastic nut 12.

Figure 4:
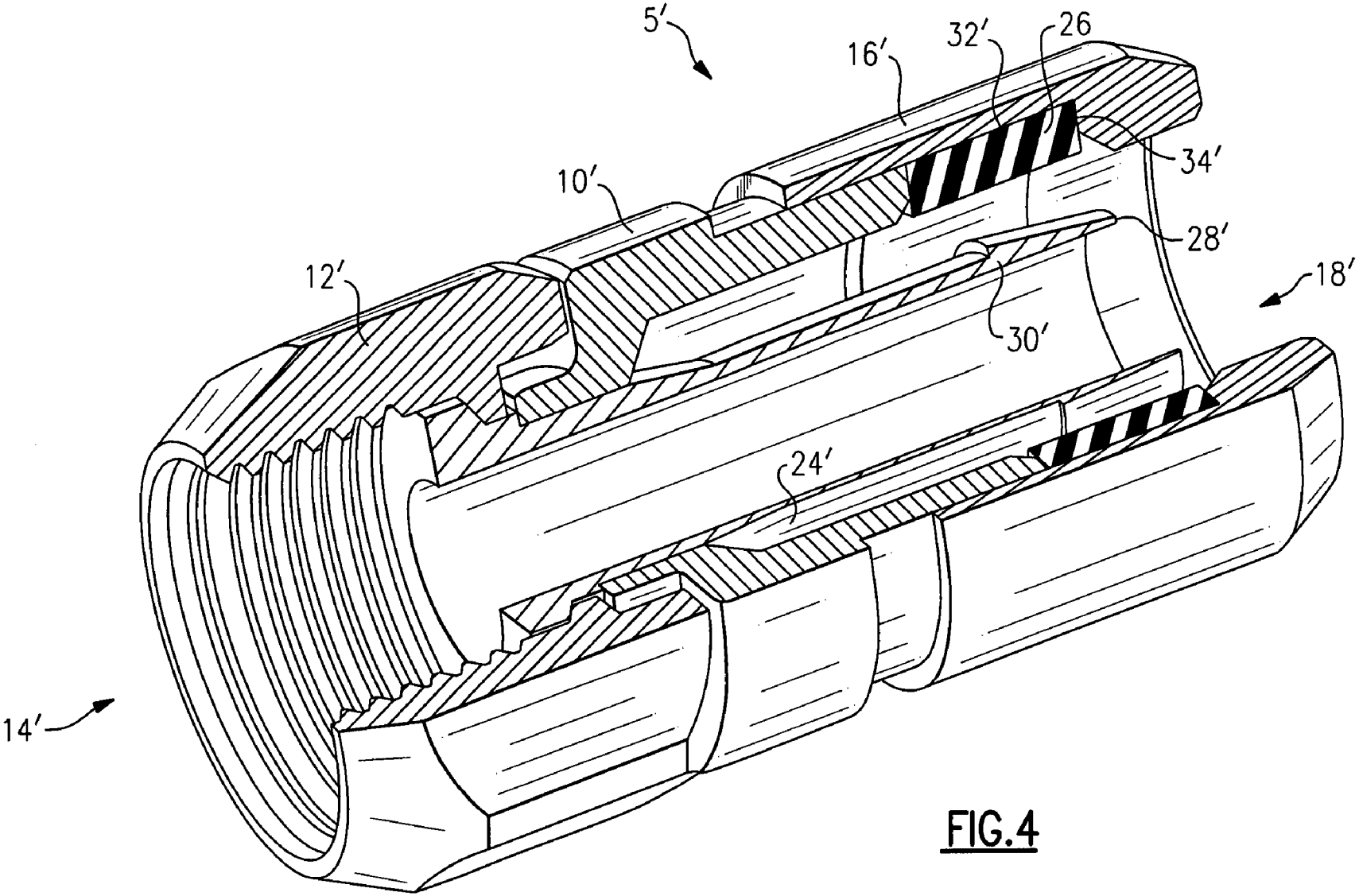
FIG. 4 shows a partial cutaway perspective view of an embodiment of the invention where the connector components are of metal.

Referring to FIG. 4, another embodiment of the present invention is shown. A connector 5' includes a connector body 10' with a nut 12' on a front end 14' of body 10'. Nut 12' is shown in this embodiment as a nut for connecting connector 5' to an F-port, but the type of connection is not an essential part of the present invention. A compression fitting 16' is connected to body 10' at a back end 18' of body 10' via a sleeve 21 on compression fitting 16' engaging a portion 23 of body 10'. A post 24' is contained within connector 5'. An elastomeric band 26 is disposed within a cavity 32' formed in part by a shoulder 34' of compression fitting 16'. As the coaxial cable end (not shown) is inserted into back end 18' of connector 5', an end 28' of post 24' fits between the cable sheath and the cable dielectric, so that the dielectric and center conductor fit inside post 24', with the sheath and cable jacket between post 24' and connector body 10'.

Post 24' preferably includes a barbed portion 30', and as compression fitting 16' is pushed onto body 10', elastomeric band 26 is forced to deform around the cable jacket, resulting in decreased length and increased thickness. In it's "open" position, i.e., when compression fitting 16' is not tightened onto body 10', band 26 has enough clearance to allow the cable to pass through easily. By axial compression, band 26 is squeezed inward onto the cable, thus creating a weather seal, as well as providing a great deal of normal force between elastomeric band 26 and the cable sheathing, thus providing retention force to the cable/connector combination. In addition to the tractive forces created by surface friction, the coaction of barbed portion 30' under the cable sheathing along with the inward pressure of elastomeric band 26 cause the cable sheath to conform closely to the profile of barbed portion 30', thus creating a mechanical interlock.

Figure 5:
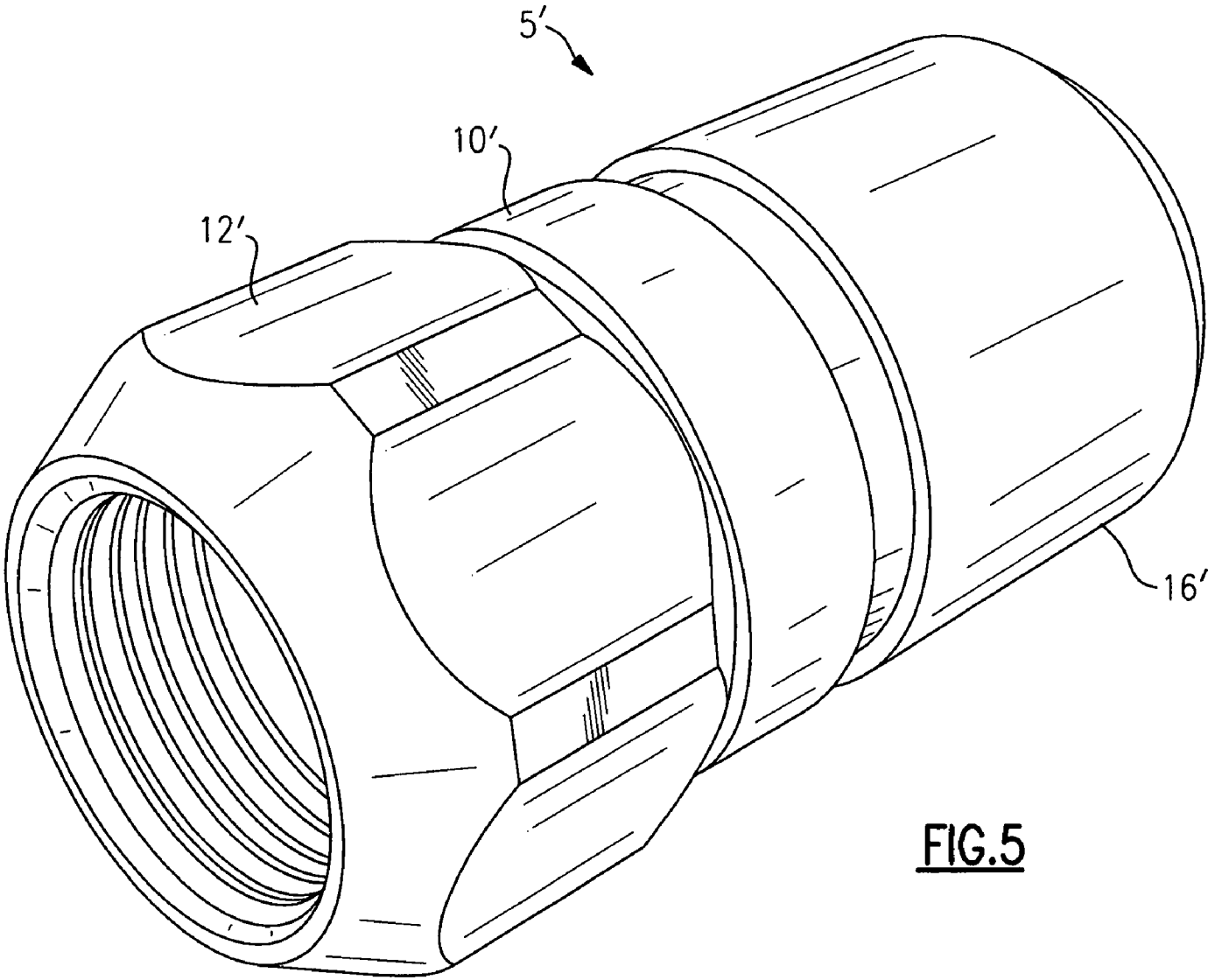
FIG. 5 shows a perspective view of an embodiment of the invention, prior to installation, where the connector components are of metal.
Figure 6:
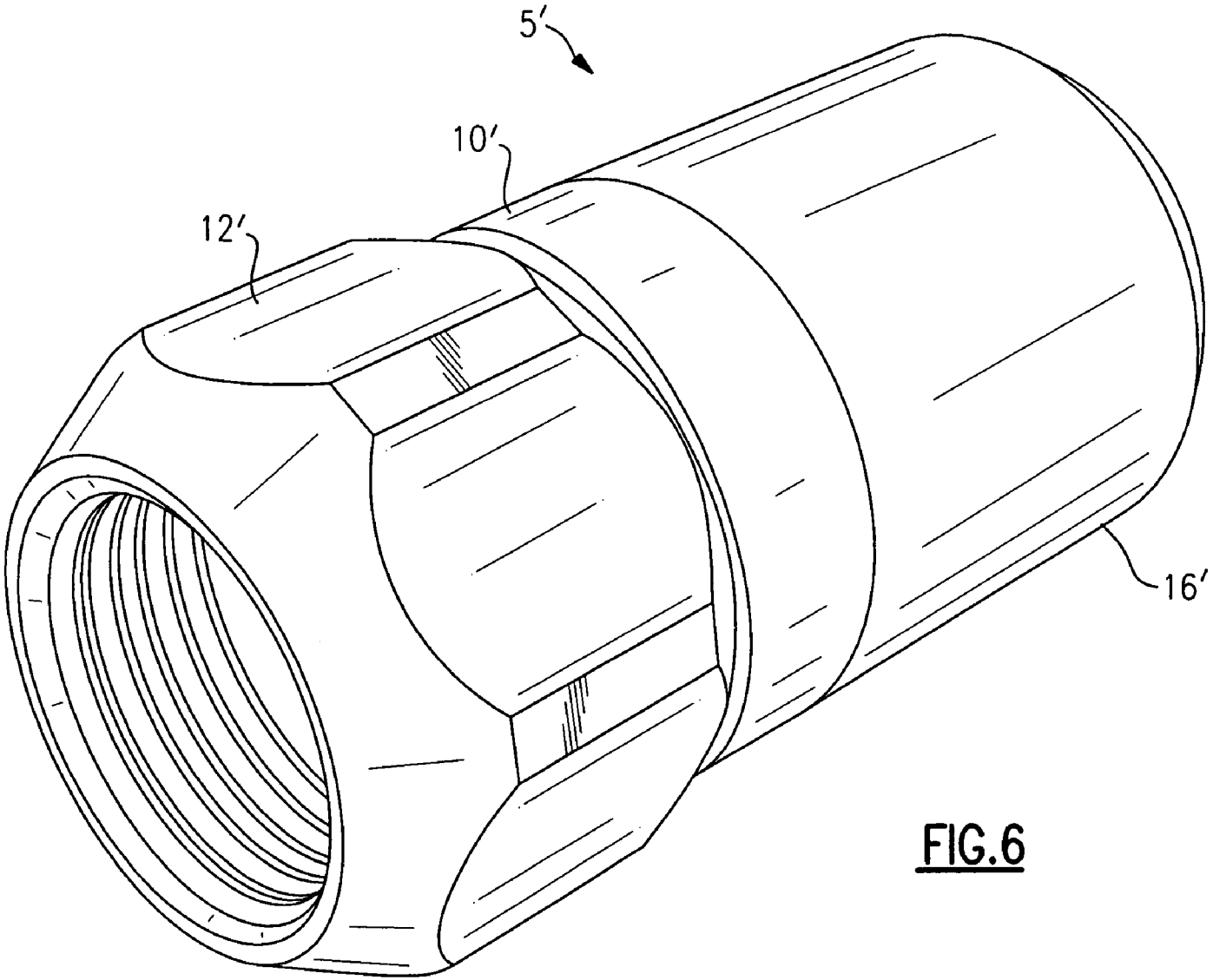
FIG. 6 shows a perspective view of an embodiment of the invention, after installation, where the connector components are of metal.

FIG. 5 shows an external view of a metal version of FIG. 4 prior to installation, while FIG. 6 shows the embodiment of FIG. 5 after the embodiment has been installed on a cable (not shown). The metal version, intended primarily for outdoor use, can have a brass nut 12', a brass or stainless steel post 24', a brass or diecast zinc body 10', and a brass or stainless steel compression fitting 16'.

Figure 7:
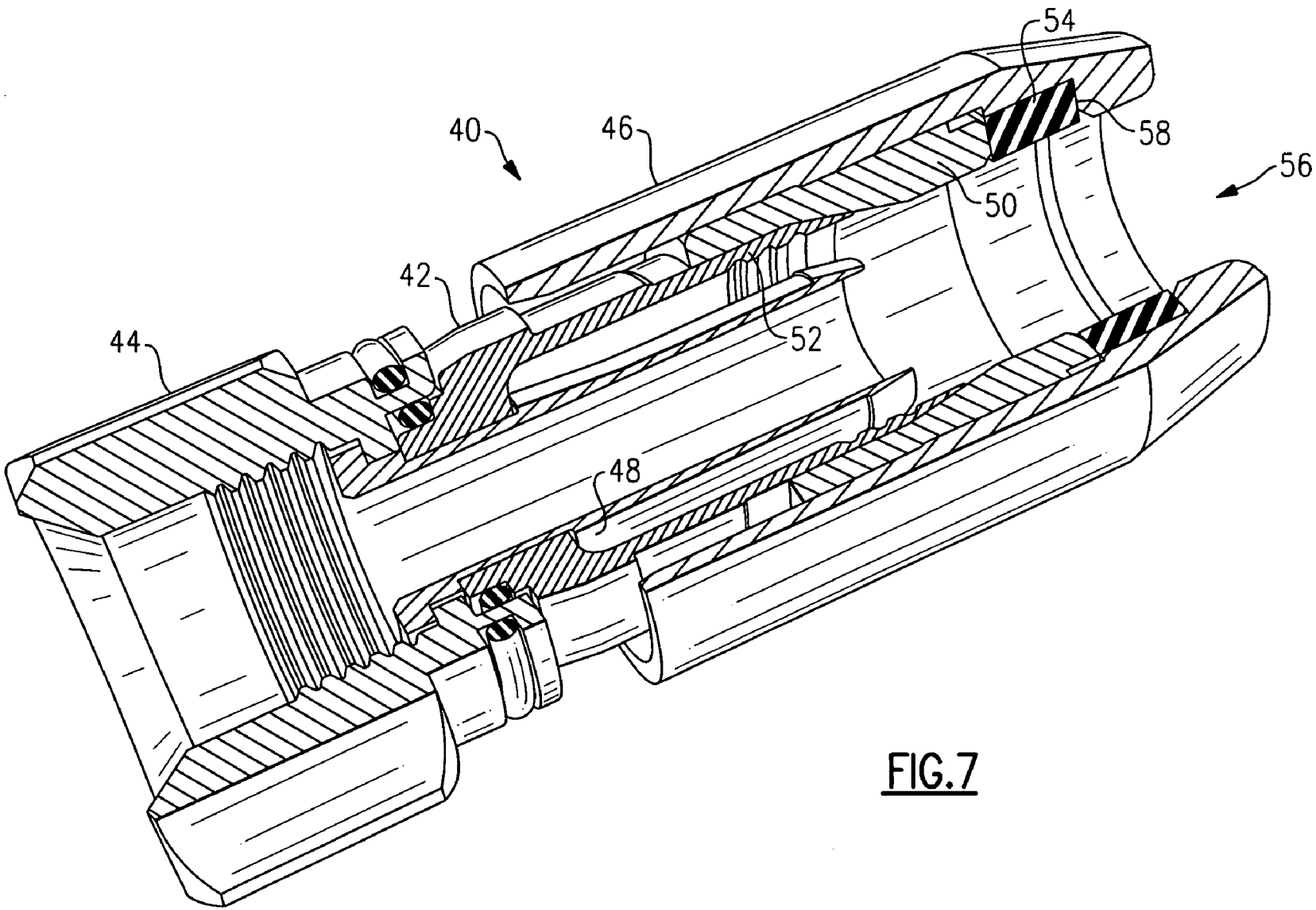
FIG. 7 shows a partial cutaway perspective view of an embodiment of the invention.

Referring to FIG. 7, an embodiment is shown in which the elastomeric band of the present invention is used in addition to the seal already present in a cable connector. A cable connector 40 includes a connector body 42 to which a nut 44 is connected. Nut 44 attaches cable connector 40 to a piece of equipment or another connector. A post 48, extending inside body 42, is connected to both nut 44 and body 42. A driving member 50 overlaps a sealing portion 52 of body 42. A compression member 46 fits over both driving member 50 and a part of body 42. In normal operation, a prepared cable end (not shown) is inserted into connector 40 through a back end 56. When compression member is forced axially towards a front end of connector 40, driving member 50 forces sealing portion 52 radially against the cable, thus providing a seal against the outside environment. In this embodiment, an elastomeric band 54 fitted into a cavity 58 formed within compression member 46 and an end of driving member 50 provides extra sealing against the cable by axial compression. When band 54 is squeezed inward onto the cable, it creates a weather seal, as well as a great deal of normal force between elastomeric band 54 and the cable sheathing, thus providing retention force to the cable/connector combination.

Examples of elastomers include any thermoplastic elastomer (TPE), silicone rubber, or urethane. The key properties are resilience, resistance to creep, resistance to compression set, and the creation of a good grip with the cable jacket. The length of band 26, i.e., in the axial direction of connector 5, can be equal to the length of the cavity in which it is seated. The important consideration is that any pre-compression done to band 26 must not affect insertion of the cable end, i.e., the thickness of elastomeric ring 26 cannot become so large during pre-compression as to impede insertion of the cable end.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A connector for a coaxial cable, comprising:

a connector body;

a fastening member for connecting said connector to an object;

a post including a barbed portion, said post fitted at least partially inside said connector body for receiving a prepared end of said cable;

a compression member fitted to said connector body radially outward of the barbed portion of the post; and an elastomeric band fitted inside a cavity formed at least in part by said compression member;

wherein axial movement of said compression member onto said connector body causes said elastomeric band to deform and seal an outer layer of said cable to said connector to isolate an inside of said connector from environmental influences.

2. A connector according to claim 1, wherein said connector body, said compression member, and said fastening member are of plastic, and said post is of an electrically conductive material.

3. A connector according to claim 1, wherein said connector body, said compression member, said fastening member, and said post are all of metal.

4. A connector for a coaxial cable, comprising: a connector body;

first connection means for connecting said connector to an object; and second connection means for connecting a prepared end of said cable to said connector;

wherein said second connection means includes a post having a barbed portion, an elastomeric band radially outward of said barbed portion, said band forming a seal against an outer layer of said cable.

5. A connector according to claim 4, wherein said second connection means includes means for axially moving a compression member onto said connector body, and said elastomeric band is fitted inside a cavity formed at least in part by said compression member.

6. A connector according to claim 4, wherein said connector body, said first connection means, and said second connection means are of plastic, and said receiving means is of an electrically conductive material.

7. A connector according to claim 4, wherein said connector body, said first connection means, said second connection means, and said receiving means are all of metal.

8. A method of constructing a connector for a coaxial cable, comprising the steps of:

providing a connector body;

fitting a metal post having a barbed portion at least partially inside said connector body, providing a fastening member for fastening said connector body to an object;

providing a compression member;

fitting an elastomeric band into a cavity formed at least in part by said compression member;

inserting a prepared end of said cable through said compression member and said elastomeric band; and fitting said prepared cable end and said compression member to said connector body, wherein axial movement of said compression member onto said connector body causes said elastomeric band to deform and seal against an outer layer of said cable radially outward of the barbed portion of the post.

9. A method according to claim 8, wherein said connector body, said fastening member and said compression member are of plastic.

10. A method according to claim 8, wherein said connector body, said fastening member and said compression member are of metal.

11. A method according to claim 8, wherein said step of fitting said prepared cable end and said compression member to said connector body includes the step of fitting a ground sheath of said cable between said connector body and a metal post, and fitting a center conductor an dielectric portion of said cable inside said metal post.

12. A coaxial cable connector, comprising:

a connector body having a first end and a second end, said second end including external threads;

a post having a first end, a second end and a barbed portion, said post fitting at least partially within said connector body and said second end of the post adapted for insertion into an end of a coaxial cable;

a fastening member operatively attached to one of said first end of said body or said first end of said post;

a compression member having internal threads complementary to said external threads on the second end of the body; and an elastomeric band fitted inside a cavity formed at least in part by said compression member and said body;

wherein axial advancement of said compression member onto said connector body causes said elastomeric band to deform and seal against an outer layer of said cable radially outward of the barbed portion of the post.

13. The connector of claim 12 wherein said first end of the body partially covers a portion of said fastener member.

14. The connector of claim 13 wherein the first end of the body at least partially covering said fastener member is adapted to facilitate manual rotation of the body member independently of the rotation of said compression member.

15. The connector of claim 13 wherein the first end of the body defines a plurality of reveals permitting manual manipulation of the fastener member.

16. The connector of claim 12 wherein the nut has a textured surface to facilitate gripping and turning said nut.

17. The connector of claim 12 wherein the compression member further includes a non-cylindrical external surface adapted to facilitate manual rotation of said compression member about said body.

18. The connector of claim 17 wherein the non-cylindrical external surface of the compression member is elliptical in cross-section.

19. The connector of claim 12 wherein the compression member has an internal shoulder.

20. The connector of claim 19 wherein the internal shoulder of the compression member forms part of the cavity for receiving the elastomeric band.

21. The connector of claim 12 wherein said connector body, said compression member, and said fastener member are comprised of plastic, and said post is comprised of an electrically conductive material.

* * * * *